US007844032B2

(12) United States Patent
Vermilyea et al.

(10) Patent No.: US 7,844,032 B2
(45) Date of Patent: Nov. 30, 2010

(54) APPARATUS FOR PROVIDING COLLIMATION IN A MULTISPOT X-RAY SOURCE AND METHOD OF MAKING SAME

(75) Inventors: Mark E. Vermilyea, Niskayuna, NY (US); Colin R. Wilson, Niskayuna, NY (US); Yun Zou, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 118 days.

(21) Appl. No.: 12/252,609

(22) Filed: Oct. 16, 2008

(65) Prior Publication Data

US 2010/0098219 A1 Apr. 22, 2010

(51) Int. Cl.
*G21K 1/02* (2006.01)

(52) U.S. Cl. ..... 378/149; 378/9

(58) Field of Classification Search ..... 378/4, 378/9, 124, 137, 138, 145, 147, 148, 149, 378/150

See application file for complete search history.

(56) References Cited

U.S. PATENT DOCUMENTS 2,720,607 A 10/1955 Criscuolo et al.
2,764,706 A 9/1956 Atlee
3,752,990 A 8/1973 Fischer
5,065,419 A 11/1991 Leguen et al.
5,293,417 A * 3/1994 Wei et al. ..... 378/147
5,631,944 A 5/1997 Kimura et al.
7,305,063 B2 12/2007 Heuscher
7,476,023 B1 1/2009 Canfield et al.
2005/0002491 A1 1/2005 Lenz
2010/0061514 A1 * 3/2010 Harding ..... 378/87
2010/0098218 A1 4/2010 Vermilyea et al.

OTHER PUBLICATIONS

U.S. Appl. No. 12/252,594, Office Action dated Mar. 23, 2010.
Inverse System Geometry Reduces Scatter Radiation, NovaRay, 3 pages, downloaded on Aug. 4, 2010, http://www.novaraymedical.com/novaRay/technology_inverse_systems.html.
"Platinum Metals Review," vol. 1, No. 3, Jul. 1957.

* cited by examiner

*Primary Examiner*—Hoon Song
(74) *Attorney, Agent, or Firm*—Scott J. Asmus

(57) ABSTRACT

A collimator includes a first plate having an aperture therein, the aperture configured to allow passage of a beam of x-rays from a source of a multi-spot source therethrough, and a second plate parallelly positioned with respect to the first plate and configured to receive and attenuate a first portion of the beam of x-rays passing through the aperture in the first plate, the second plate having an aperture therein configured to non-concentrically overlap the aperture in the first plate, to receive a second portion of the beam of x-rays passing through the aperture in the first plate, and to allow passage of the second portion of the beam of x-rays therethrough. A portion of the aperture in the first plate and a portion of the aperture in the second plate form a composite aperture parallel to the beam of x-rays, the composite aperture configured to allow passage of the second portion of the beam of x-rays through the first and second plates.

22 Claims, 10 Drawing Sheets

APPARATUS FOR PROVIDING COLLIMATION IN A MULTISPOT X-RAY SOURCE AND METHOD OF MAKING SAME

BACKGROUND OF THE INVENTION

Embodiments of the invention relate generally to diagnostic imaging and, more particularly, to a modular multispot x-ray source for use in an imaging system.

Traditional x-ray imaging systems include an x-ray source and a detector array. X-rays are generated by the x-ray source, passed through and attenuated by an object, and are detected by the detector array. Hereinafter, the terms "subject" and "object" shall include anything capable of being imaged. The intensity of the attenuated beam radiation received at the detector array is typically dependent upon the attenuation of the x-ray beam by the object. Each detector element of the detector array produces a separate electrical signal indicative of the attenuated beam received by each detector element. The electrical signals are transmitted to a data processing system for analysis, which ultimately produces an image.

Generally, as in a CT application, the x-ray source and the detector array are mounted on a gantry and rotated about an imaging plane and around the object. X-ray sources typically include x-ray tubes, which emit the x-ray beam at a focal point. X-ray detectors typically include a collimator for collimating x-ray beams received at the detector, a scintillator adjacent the collimator for converting x-rays to light energy, and photodiodes for receiving the light energy from the adjacent scintillator and producing electrical signals therefrom. The X-ray detectors may also include a direct conversion device for discriminating the energy content of the x-ray beam. The outputs of the detector array are then transmitted to the data processing system for image reconstruction. Electrical signals generated by the detector array are conditioned to reconstruct an x-ray image of the object.

In CT imaging systems, the gantry rotates at various speeds in order to create a 360° image of the object. The gantry contains an x-ray source having an electron source or cathode assembly that generates electrons that are accelerated across a vacuum gap to a target or anode assembly via a high voltage potential. In releasing the electrons, a filament contained within the electron source is heated to incandescence by passing an electric current therethrough. The electrons are accelerated by the high voltage potential and impinge upon a target surface of the target at a focal spot. Upon impingement, the electrons are rapidly decelerated, and in the process, x-rays are generated therefrom.

The process of deceleration typically results in heating of the focal spot to very high temperatures. Thus, x-ray tubes include a rotating target or anode structure for the purpose of distributing heat generated at the focal spot. The target is typically rotated by an induction motor having a cylindrical rotor built into a cantilevered axle that supports a disc-shaped target and an iron stator structure with copper windings that surrounds an elongated neck of the x-ray tube. The rotor of the rotating target is driven by the stator. Because of the high temperatures generated when the electron beam strikes the target, the target is typically rotated at high rotational speed.

Newer generation x-ray tubes have increasing demands for providing higher peak power, thus generally higher average power as well. Higher peak power, though, would result in higher peak temperatures occurring in the target, particularly at the "track" or the point of impact on the target, unless the target design is altered. Because x-ray tubes are typically designed having peak temperatures at limits imposed by material capabilities and high voltage considerations, higher peak power typically calls for a re-design of the target. For a rotating target, the re-design may include higher rotation speed, larger track radius, or novel x-ray production means. These designs may reduce life and reliability of the rotating target. For stationary target sources, the re-design options are generally limited to material improvements or novel approaches to backscattered electron energy management.

Furthermore, newer generation CT systems have increased gantry speed requirements to better enable, for instance, cardiac imaging. Thus, systems have been designed having applications wherein the gantry is spun at or below 0.5 seconds rotational speed. Such applications may include yet faster gantry rotation, thereby increasing the g-load demands to, for instance, 0.2 second rotation, which represents a g-load well in excess of what can be withstood in many current CT systems.

Accordingly, to counter the need for high g-load capability x-ray sources, multispot systems have been designed having stationary imaging components therein. For instance, scanning electron beam (e-beam) x-ray sources include an electron gun positioned at a gantry center that emits an e-beam that is magnetically deflected toward a target. In such a system, the target typically forms a continuous ring surrounding a patient, and the e-beam is rapidly deflected to circumferential locations on the target and around the patient. The e-beam may be deflected in the z-direction as well. As such, multispot imaging may be performed very rapidly using stationary components. However, not only are such systems expensive, they may be prone to performance degradation as well. For instance, the continuous target may have thermal distortion that can degrade image quality through excessive focal spot motion.

Furthermore, other known systems having stationary components include a thin transmission-style target for x-ray generation. However, such a continuous target is likewise prone to thermal loading and distortion effects resulting, as well, in degraded image quality through excessive focal spot motion.

As such, modular multispot devices have been developed to reduce the thermal distortion effects resulting from large, continuous targets or anodes. In such a system, individual, modularized x-ray sources may be positioned within a gantry, each module having a plurality of individual or discrete focal spots that have reduced relative motion. As such, the overall system thermal distortion may be minimized and image quality may be improved. A modular design has the benefit of simplifying manufacturing and assembly procedures because the individual modules may be assembled and tested as subunits before being installed into the overall system. Such a design further simplifies troubleshooting and repair of the system in the field, as a field engineer may be able to test and replace individual modules within the system. Thus, the need to return all of the sources or even the entire system back to a manufacturing site may be precluded, resulting less in system downtime, cost of repair, and frustration.

However, a multispot source typically results in the need to provide x-ray shielding of many spatially distributed focal spots. Adopting a traditional shielding approach would require covering the vacuum chamber containing the modules with lead or other high-density shielding material to eliminate the openings from which undesired x-rays could emanate. This presents at least two issues: first, the basic amount of shielding material would be large; and second, the amount of scattered radiation produced by objects inside the vacuum chamber makes the determination of the minimum thickness of shielding material required at all locations difficult.

Thus, not only is the basic amount of shielding material prohibitive, but because of the variation from system to system and the resulting uncertainty of sources of scattered radiation and to be conservative, designs typically include excess amounts of shielding. This results in increased system cost and an unnecessary amount of shielding mass being included in the system. As such, the desire for increased g-load capability may be limited due to the excess shielding required in a modular source design.

Furthermore, modular source designs typically include a pre-patient collimator to collimate scatter and off-focal radiation that may emit from the anodes. However, to collimate each spot within a multispot source, a separate collimator is provided for each spot, resulting in a series of individually constructed collimators. Further, in order to collimate in both the X and Z dimensions, respective collimating plates or elements must be provided in each orientation. Such a construction is complex and expensive to build, and cumbersome and difficult to operate.

Therefore, it would be desirable to design a collimator that collimates each spot in both X and Z dimensions for a modular multispot x-ray source.

BRIEF DESCRIPTION OF THE INVENTION

Embodiments of the invention provide a apparatus and method that overcome the aforementioned drawbacks. Embodiments of the invention are directed to an apparatus and method of manufacturing a cost-effective modular multispot x-ray source having robust g-load capability and improved.

According to one aspect of the invention, a collimator includes a first plate having an aperture therein, the aperture configured to allow passage of a beam of x-rays from a source of a multi-spot source therethrough, and a second plate parallelly positioned with respect to the first plate and configured to receive and attenuate a first portion of the beam of x-rays passing through the aperture in the first plate, the second plate having an aperture therein configured to non-concentrically overlap the aperture in the first plate, to receive a second portion of the beam of x-rays passing through the aperture in the first plate, and to allow passage of the second portion of the beam of x-rays therethrough. A portion of the aperture in the first plate and a portion of the aperture in the second plate form a composite aperture parallel to the beam of x-rays, the composite aperture configured to allow passage of the second portion of the beam of x-rays through the first and second plates.

In accordance with another aspect of the invention, a method includes providing a multispot x-ray source having first and second focal spots that are in different positions from one another, providing a first collimator plate having a plurality of apertures therein, and providing a second collimator plate having a plurality of apertures therein, each aperture in the second collimator plate corresponding to a respective aperture in the first collimator plate to form a respective aperture pair. The method further includes positioning the first collimator plate substantially parallel to the second collimator plate and between the second collimator plate and the x-ray source, and offsetting an axial center of each aperture in each respective aperture pair from one another in a direction coplanar with the first collimator plate such that a composite opening is formed in each respective aperture pair between a portion of each aperture in each respective aperture pair.

Yet another aspect of the invention includes an x-ray imaging system that includes a multispot x-ray source. The multispot source includes a first emitter positioned to emit a first x-ray beam toward an object, and a second emitter positioned to emit a second x-ray beam toward the object, the second emitter positioned in a different position from the position of the first emitter. The system also includes a collimator that includes a first x-ray-opaque sheet having a first aperture therein and positioned to receive x-rays from the first emitter, and a second x-ray-opaque sheet having a second aperture therein and positioned to receive x-rays that pass through the first x-ray-opaque sheet, wherein the second x-ray-opaque sheet is substantially parallel to the first metal sheet. The first aperture is parallelly offset from the second aperture such that the two apertures form a composite opening therethrough, the composite opening smaller than the first aperture, and the composite opening smaller than the second aperture.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the invention is described with respect to a sixty-four-slice computed tomography (CT) system. However, it will be appreciated by those skilled in the art that the invention is equally applicable for use with other multi-slice configurations. The invention will be described with respect to a "third generation" CT scanner, but is equally applicable with other CT systems.

Figure 1:
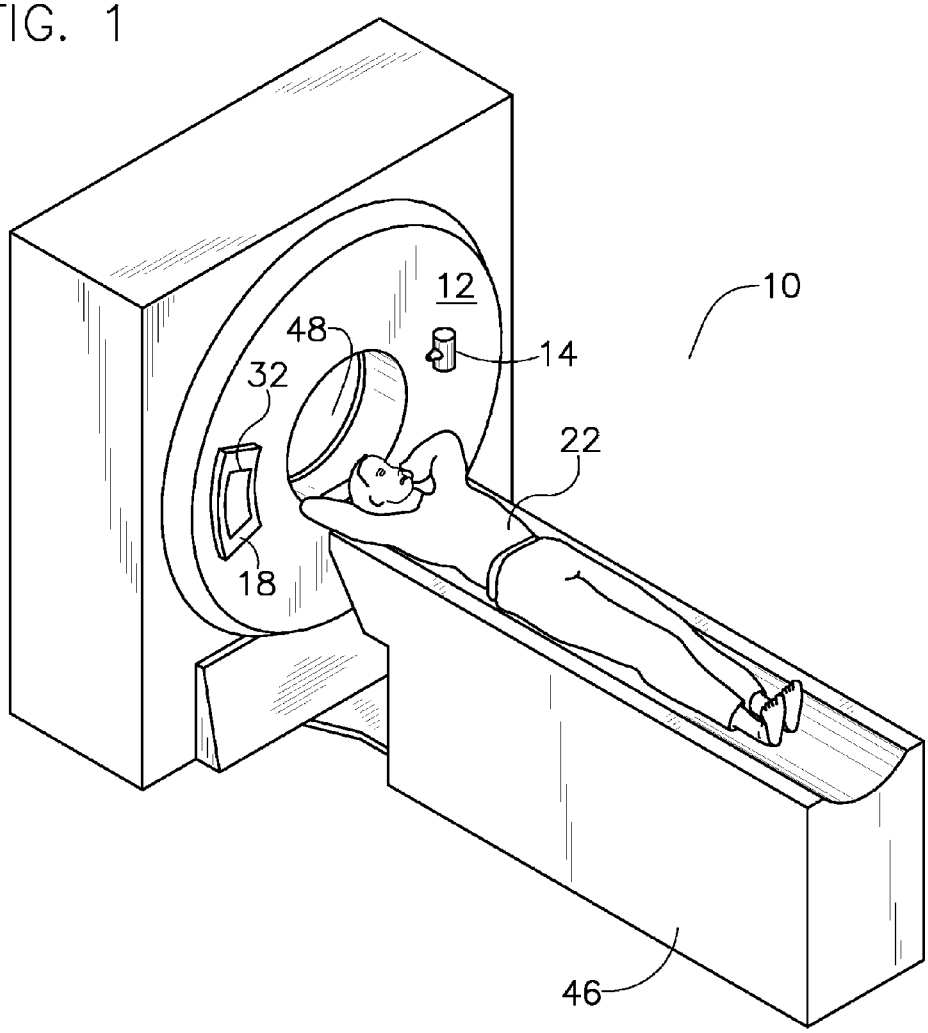
FIG. 1 is a pictorial view of a CT imaging system.
Figure 2:
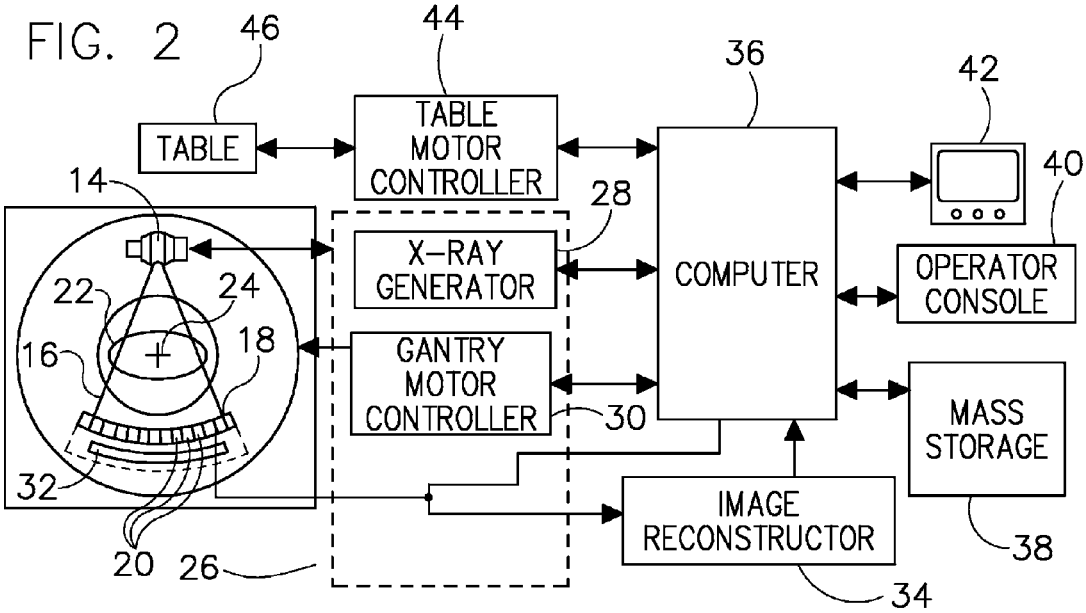
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray source 14 that projects a beam of x-rays toward a detector assembly or collimator 18 on the opposite side of the gantry 12. Referring now to FIG. 2, detector assembly 18 is formed by a plurality of detector elements 20 and a data acquisition system (DAS) 32. The detector elements 20 sense the projected x-rays 16 that pass through an object or medical patient 22, and DAS 32 converts the data to digital signals for subsequent processing. Each detector element 20 produces an analog electrical signal that represents the intensity of an impinging x-ray beam after attenuation by the imaged object 22. During a scan to acquire x-ray projection data, gantry 12 and the components mounted thereon rotate about an axis 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. An image reconstructor 34 receives sampled and digitized x-ray data from DAS 32 and performs high-speed reconstruction. The reconstructed image is applied as an input to a computer 36 which stores the image in a mass storage device 38.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a controller 44 to position a motorized table 46 and hence patient 22 and gantry 12. Particularly, table 46 moves patients 22 through a gantry opening 48 of FIG. 1 as required to provide an image of the desired volume.

The x-ray source 14 may include a modular design according to an embodiment of the invention. In this embodiment, referring to FIG. 3, a module 100 includes an electron source support or mounting plate 102 and a support, or target support or target block 104. The two supports 102, 104 are structurally separated by high-voltage stand-offs, or insulators, 106 and 108. In one embodiment, mounting plate 102 is fabricated of stainless steel or other rigid material, and target support 104 is fabricated of copper or other thermally conductive material. The insulators 106, 108 are fabricated from an electrically insulating material such as alumina, aluminum nitride or other insulating material, and may be mounted to the supports 102, 104 via clamping hardware or bolts, as is understood within the art. Metal shields 105 reduce electrical field concentration and thus flashover risk at the insulator-to-shield-to-vacuum triple point. The metal shields 105 are attached to their respective supports 102, 104, and are also attached to the insulators 106, 108. Thus, the supports 102, 104 are electrically isolated one from the other via the insulators 106, 108 such that the supports 102, 104 may withstand up to 140 kV or more therebetween. In one embodiment the supports 102, 104 are configured to withstand a voltage in excess of 450 kV. A plurality of cathodes or electron sources 110 are mounted on the electron source support plate 102, and, in one embodiment, a plurality of anodes or targets 112 are mounted on the target block 104 within cavities 136, 138, 140. The targets 112 include a W—Re layer mounted and either bolted or brazed to a TZM structure. In another embodiment, a single anode or target 112 is configured along a width of the module and is positioned to receive electrons from multiple electron sources 110, thus having an array of multiple focal spots 151 on the single target 112.

The electron sources 110 are configured as sub-modules, three of which are illustrated 114, 115, 117, and each of which includes, in the illustrated embodiment, four electron sources 110. Each electron source 110 is positioned opposite a respective target 112. As described, targets 112 may include separate structures corresponding to respective electron sources 110, or a single target 112 may span along multiple electron sources 110 within each sub-module 114, 115, 117 such that multiple focal spots emanate from a single target 112. The electron source sub-modules 114, 115, 117 are mounted on the electron source mounting plate 102 via electron source support blocks 116. The electron source sub-modules 114, 115, 117 and their respective electron source support blocks 116 may be mounted on additional spacers 118, 119 such as illustrated for electron source sub-modules 114, 115, such that target-electron source spacing may be controlled independently for each electron source sub-module 114, 115. As illustrated, the spacers 118, 119 are designed to position each electron source 110 within each electron source sub-module 114, 115, 117 at a proper spacing with respect to its respective target 112. The electron source sub-modules 114, 115, 117 are positioned opposite respective target sub-modules 130, 132, 134. Thus, a 4×3 array of 12 target-electron source pairs are illustrated in the module 100.

One skilled in the art will recognize that the module 100 need not be limited to three source sub-modules 114, 115, 117, and respective target sub-modules 130, 132, 134. Nor does the number of electron sources 110 need to be limited to four within each sub-module 114. As such, a module 100 may include more or less than the 12 pairs illustrated in FIG. 3. In embodiments, electron sources (each having respective targets) are arranged in a two-dimensional matrix pattern having M rows of electron sources and N columns of electron sources, wherein M and N are each greater than or equal to 2. The extent and form factor of this array is governed by the geometry of the desired image volume and the system, as well as mechanical and electrical design considerations.

The electron sources 110 are positioned such that electrons are emitted substantially orthogonal therefrom and received from each respective electron source 110 on a focal spot surface of targets 112 at an angle of between 0° and 90°. In a preferred embodiment the angle is between 10° to 40°. Each target 112 includes tungsten, molybdenum, and/or alloys thereof including other materials, for generation of x-rays, as is commonly understood within the art. Alternatively, each electron source 110 may include field emitters. The target block 104, with its plurality of targets 112, further includes a target cover 120, positioned on the target block 104 and having a plurality of holes or passageways 122 therein. The passageways 122 are positioned to allow passage of electrons from each electron source 110 to its respective target 112, while limiting the flow of backscattered electrons and ions away from the target to the tube frame and electron source, respectively.

A high voltage, such as a monopolar operation having up to 140 kV or more, is applied between the electron sources 110 and the targets 112 via the electron source plate 102 and the target block 104. In this embodiment, the 140 kV voltage difference is applied by grounding the electron source plate 102 and applying +140 kV to the target block 104. However, one skilled in the art will recognize that the voltage differential may be applied in other fashions, such as by splitting the applied kV between the target block 104 and the electron source plate 102 (i.e. a bipolar operation having +70 kV to the target block 104 and −70 kV to the electron source plate 102) or by grounding the target block 104 while applying a −140 kV bias to the electron source plate 102. The split-potential embodiment may include an additional set of insulators between the target or electron source block and the vacuum chamber and attendant changes in the electrical feedthroughs from the high voltage power supply. In one embodiment, the total applied voltage differential is 450 kV or more for, for instance, a baggage scanner in a security application, and in such embodiment the differential may be applied by grounding the anode, grounding the cathode, or splitting the applied voltage between them as discussed above.

In one embodiment, coolant (such as water, dielectric oil, or glycol, as examples) is flowed through a plurality of coolant lines 124 to remove heat generated at the targets 112. Such coolant lines may be connected via a manifold that may feed several modules, and the coolant lines may be connected to the manifold via, for instance, a vacuum-compatible connector. Accordingly, the coolant lines 124 may further serve as a means to apply a bias voltage to the module 100. Thus, as an example, in such an embodiment the electron source plate 102 may be grounded and the target block 104 may be biased to +140 kV via the cooling lines 124.

Filaments (not shown) within each electron source 110 are caused to emit beams of electrons 128 toward respective targets 112. The beams of electrons 128 emit from the electron sources 110 and are accelerated toward and impinge upon the targets 112 while passing through passageways 122. As such, x-rays 126 are generated and are emitted toward an imaging object, such as the object 22 of FIGS. 1 and 2, from a plurality of targets 112. Because of the discrete nature of the targets 112 and the ability to separately cool them via the cooling lines 124, localized and global thermal distortion of the module 100 may be minimized, thus reducing focal spot motion therefrom. Furthermore, according to this embodiment, each electron sources 110 is not limited to emission from a filament, but may also include electron sources such as field emitters (cold emission) and dispenser cathodes (thermionic emission).

The module 100 may include a shielding material according to an embodiment of the invention. FIG. 4 illustrates a side-view of the module 100 illustrated in FIG. 3. As illustrated in FIG. 4, module 100 includes target sub-modules 130, 132, 134, each having respective cavities 136, 138, 140. The cavities 136, 138, 140 each have targets 112 positioned therein and are configured to have shielding material 146 therein as well. The shielding material 146 will be described with respect to sub-module 130; however, it is to be understood that the description may apply equally to sub-modules 132, 134 as well.

Figure 3:
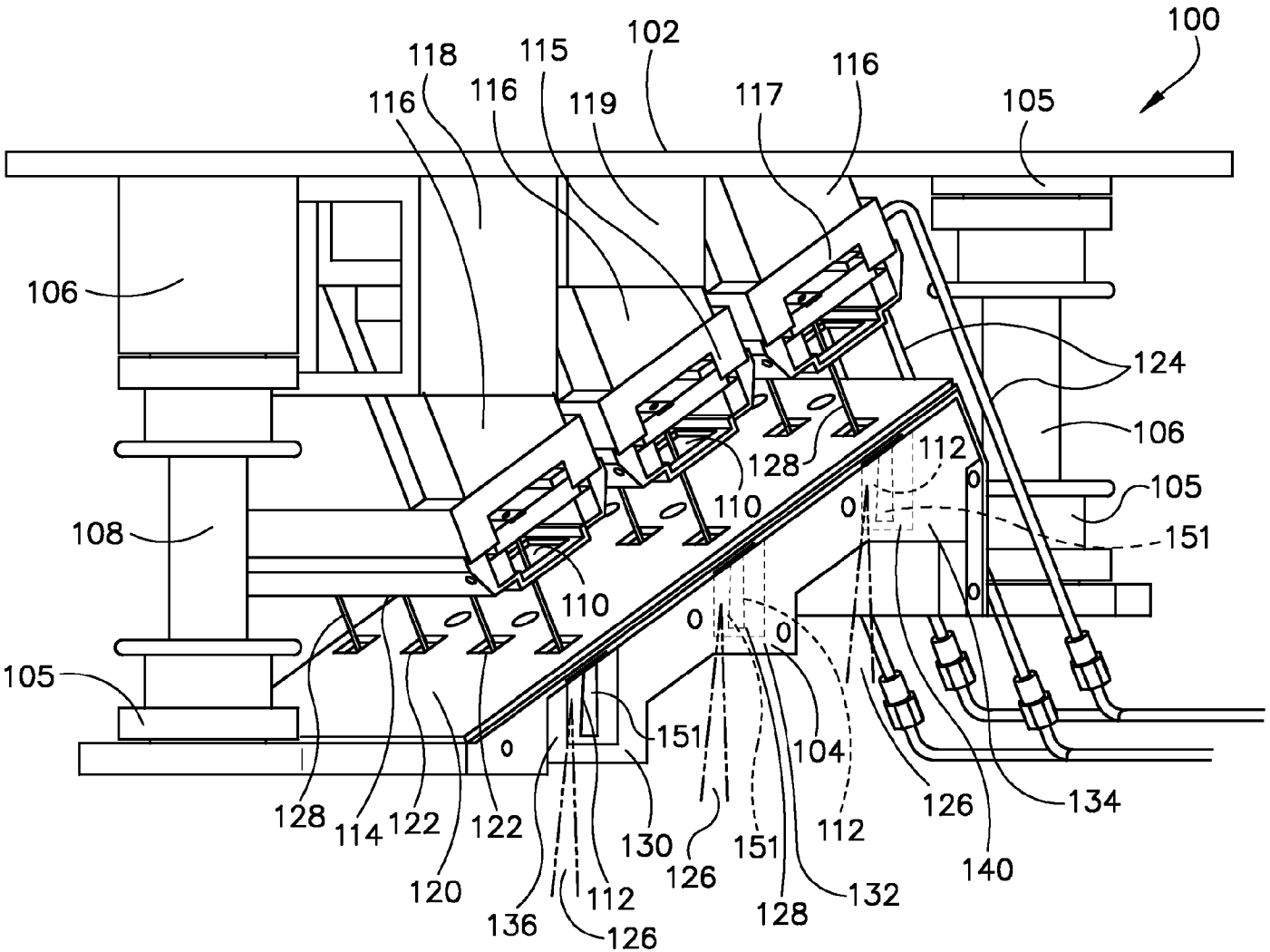
FIG. 3 is a pictorial view of a modular multispot x-ray source according to an embodiment of the invention.
Figure 4:
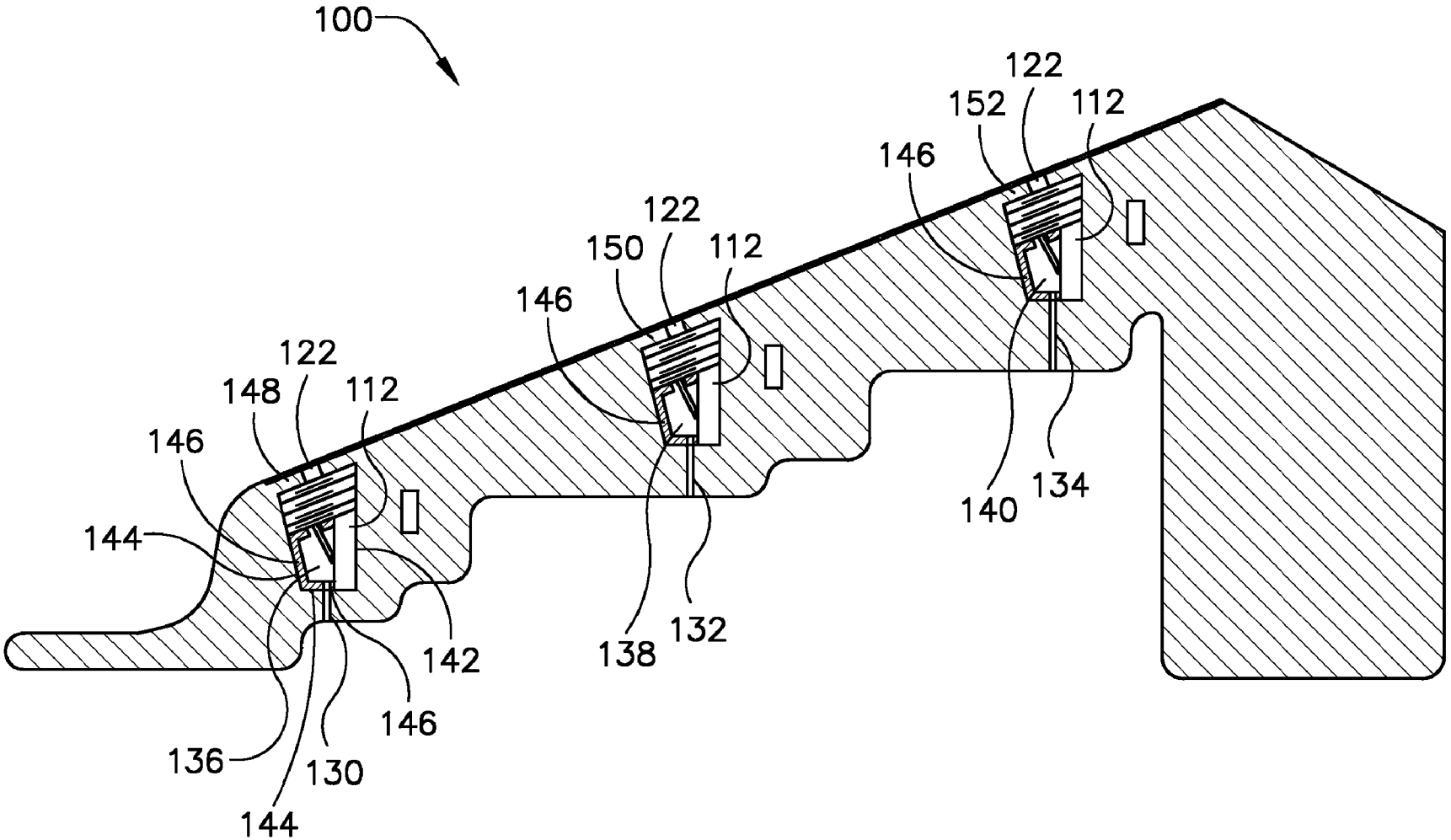
FIG. 4 is a side view of the modular multispot x-ray source illustrated in FIG. 3.
Figure 5:
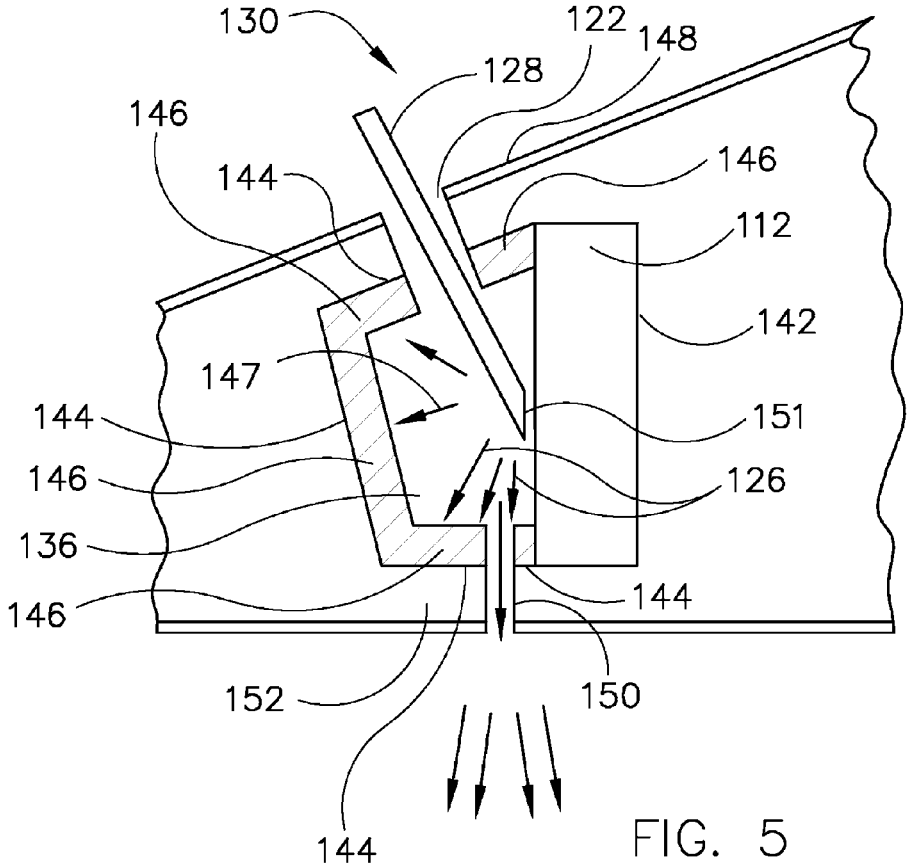
FIG. 5 is illustrates a side view of a sub-module according to an embodiment of the invention.

FIG. 5 illustrates a side view of sub-module 130 of module 100 that is configured to house a target material 112 and allow passage of the electron beam 128 that emanates from electron source 110, as illustrated in FIG. 3. Target sub-module 130 includes a cavity 136 having a first wall 142 positioned therein configured to support the one or plurality of targets 112, and configured to emit x-rays 126 from multiple focal spots 151 along the length of the cavity 136. Cavity 136 also includes walls 144 having a shielding material 146 attached thereto for attenuating back-scattered electrons 147 and for absorbing radiation. Likewise, as described with respect to FIG. 3, sub-module 130 includes holes or passageways 122 that are positioned contiguous with the cavity 136 and pass through wall 148. As such, shielding material 146 may additionally be positioned on wall 148 having passageways 122 therein. One skilled in the art will recognize that the cavities 136 need not be configured as illustrated, and may instead be configured in a circular shape or other shape.

Shielding material 146 is selected based on its ability to absorb high energy electrons and high energy x-rays. Material 146 is also selected based on its melt temperature, cost, and ease of manufacture. Thus, materials of choice include molybdenum and tungsten. In the case of tungsten, the thickness is selected to be between 1.0 mm and 4.0 mm, preferably between 2.0 mm and 3.2 mm. Molybdenum, having a lower density than tungsten, is preferably proportionately thicker than tungsten. Lead at 4.26 mm may provide adequate shielding, but may not be a preferred material because of its low melt temperature, which may cause sublimation at operating temperatures.

Figure 6:
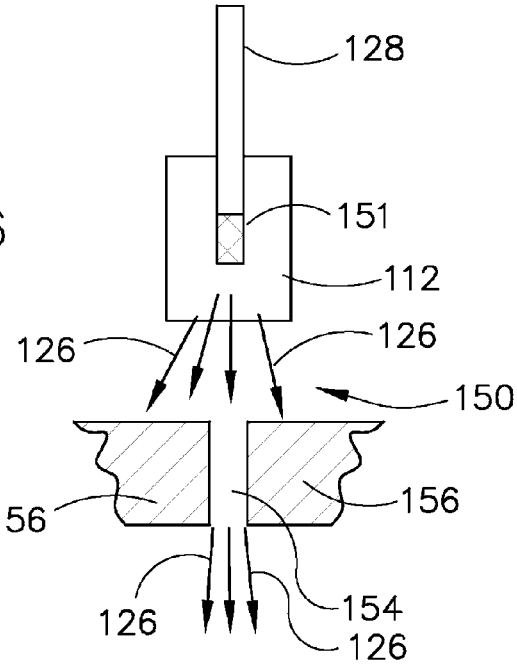
FIG. 6 illustrates a view of a focal spot according to an embodiment of the invention.

Target sub-module 130 is configured with shielding material 146 to absorb backscatter electrons 147 and radiation emitting therein and configured with passageways 122 to allow electron beam 128 to pass to the target 112. Target sub-module 130 is also configured to allow passage of x-rays 126, as described with respect to FIG. 3, that are generated at focal spots, one of which (focal spot 151) is illustrated in FIG. 6. Target sub-module 130 is configured having a passageway 150 positioned in wall 152, with passageway 150 also passing through shielding material 146. The passageway 150 may be a hole or aperture within the wall 152, or it may be a slot running along the sub-module 130. X-rays 126 generated at focal spot 151 may include undesirable off-focal radiation. Such radiation may be generated by electrons impinging on target 112 at locations other than focal spot 151, as is commonly understood in the art.

Figure 7:
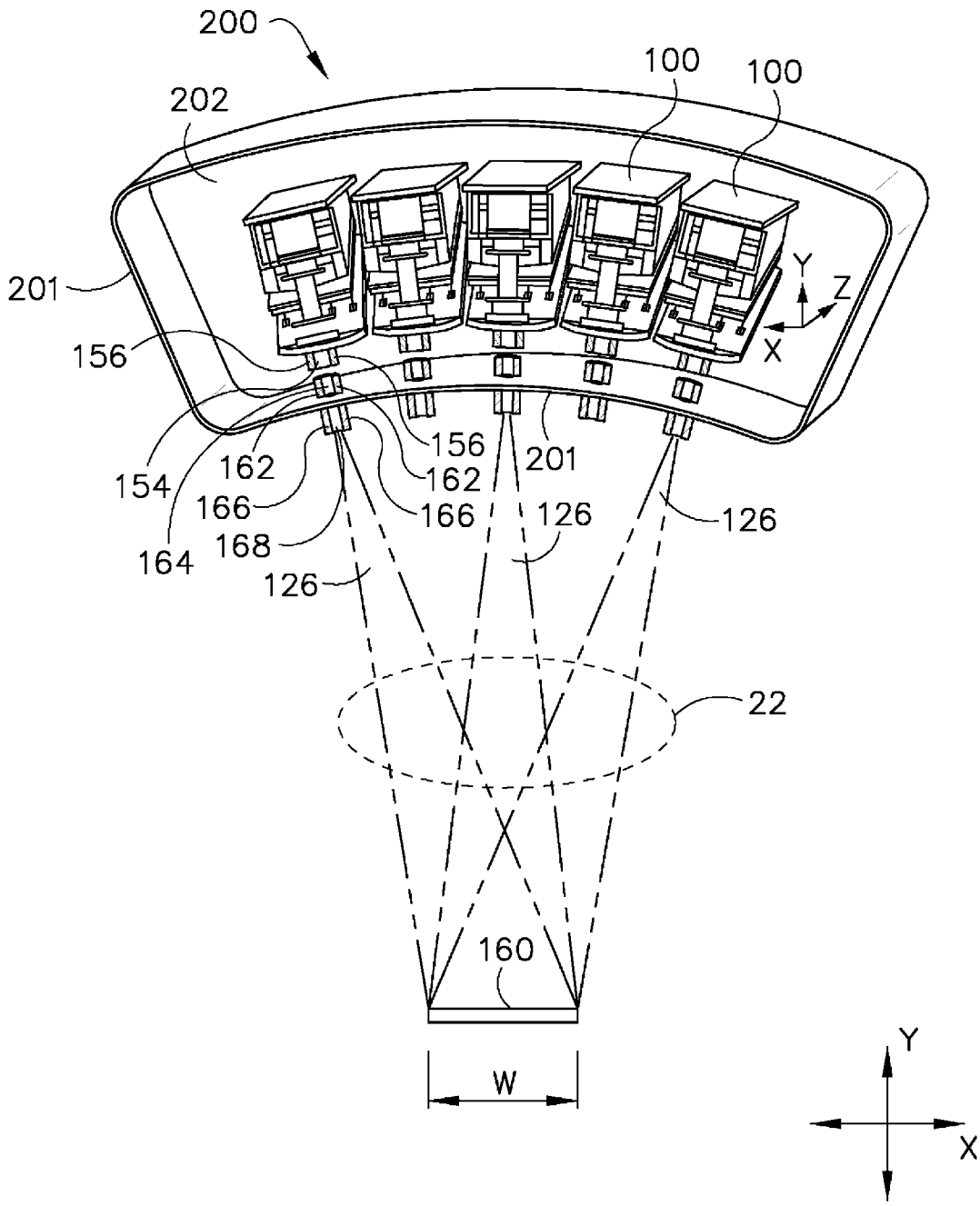
FIG. 7 illustrates a multi-spot source having collimators therein according to embodiments of the invention.

The module 100 is thus a single or stand-alone unit that may be fabricated with a vacuum chamber and inserted into, for example, a CT system such as the CT system 10 of FIGS. 1 and 2. Referring now to FIG. 7, a multi-spot source 200 includes structure 201 forming a vacuum region 202 and having a plurality of modules 100 therein according to an embodiment of the invention. As such, the multi-spot source 200 includes, in the embodiment illustrated, five modules 100, each of which includes an array of 12 target-electron source pairs and may be included in a single vacuum region 202. Thus, each module 100, as discussed with respect to FIG. 3, emits 12 x-ray beams 126 (three of which are illustrated), for a total of 60 focal spots in the illustrated embodiment.

One skilled in the art will recognize that each module 100 may house its own vacuum region. In such an embodiment, a plurality of modules 100 may be positioned within a gantry, having the advantage of enabling replacement of individual modules without having to access the vacuum region 202 as discussed above.

As discussed with respect to FIG. 3, one skilled in the art will recognize that the number of target-electron source pairs need not be 12 per module. Furthermore, one skilled in the art will recognize that the number of modules 100 need not be five, as illustrated in FIG. 3. Thus, not only may the number of target-electron source pairs be increased or decreased per module, the number of modules may be increased or decreased as well. As such, the number of electron beams 126 designed into the multi-spot source 200 may be selected, based on the requirements of the system.

Furthermore, because of the compact and stand-alone nature of the module 100, the module 100 may be structurally designed to have g-load capability in a system having 0.35 second rotation and faster. Accordingly, the multi-spot source 200 illustrated in FIG. 7 provides a plurality of x-ray sources which may be designed into a system, such as the CT system 10 illustrated in FIGS. 1 and 2. Embodiments of the invention enable a flexible number of focal spots to be designed per module 100 in a design having high g-load capability. Furthermore, a plurality of modules 100 having a minimum amount of thermal distortion therein may be included in the system 10. Embodiments of the invention described above are modular in nature, thus simplifying repair and replacement of individual modules 100 within the system 10.

Referring still to FIG. 7, a detector 160 having width "W" is positioned to receive x-rays 126 from each focal spot 151 of the multispot modules 100 that pass through the object 22. Thus, x-rays 126 emitting from each focal spot 151 within each module 100 that would impinge on the detector plane beyond the detector width "W" do not provide useful imaging data, and instead provide excess dose to object 22 that does not contribute to the image. Likewise, x-rays that exceed the Z-length of the detector 160 (in/out of the page in FIG. 7) do not provide useful imaging data as well. As such it is desirable to constrain the extent of each x-ray beam 126 to cover the width "W" and depth of the detector 160, and generally no further. Further, as discussed, each target 112 within each module 100 may generate off-focal radiation as is commonly known in the art. In other words, desirable radiation may emit from each focal spot 151 of FIG. 5, but off-focal radiation may be generated as a result of secondary electrons impinging the target 112 at a position other than each focal spot 151. Thus, it may be desirable to include collimating elements to collimate each x-ray beam 126 and pass only x-rays of x-ray beams 126 that are useful for providing imaging data.

As such, each focal spot 151 of FIG. 5 may have a corresponding collimator passage or set of collimator plates associated therewith. Thus, FIG. 6 illustrates a cross-sectional view of a portion of target sub-module 130 illustrated in FIG. 5 having collimator passage 154 positioned between collimating elements 156. As illustrated, electron beam 128 impinges upon target material 112 at focal spot 151, generating x-rays 126. The x-rays 126 may pass through the passage 150 of FIG. 5 and either impinge upon the collimating elements 156, or pass through the collimator passage 154 to detector 160 of FIG. 7, thus allowing desirable x-rays 126 to pass to the detector 160.

Referring again to FIG. 7, collimating elements 156 may thus be attached to each module 100 to create a passage 154 in the X-direction, associated with each focal spot 151 within module 100. However, in alternative embodiments, collimating elements may be attached to the structure 201 of multi-spot source 200 on either the vacuum side 202, or on the ambient side, external to the structure 201. Accordingly, elements 162 may be attached to the structure 201 on the vacuum side 202 to form aperture 164. Alternatively, elements 166 may be attached to the structure 201 on the ambient side external to structure 201 to form aperture 168.

Collimating elements 156, 162, 166 of FIG. 7 are illustrated as collimating the x-rays 126 in an X-direction with respect to the multi-spot source 200 and, as illustrated, do not provide collimation in the Z-direction, commonly known as the patient-axis, such as patient 22 in FIG. 1. Such collimating elements may be assembled according to methods known in the art. However, due to the multi-spot nature of the modules 100 within the multi-spot source 200, providing X and Z-axis collimation may increase the cost and complexity of the source 200. Thus, according to embodiments of the invention, a collimator may provide both X- and Z-axis collimation via two or more plates having apertures therein.

Figure 8:
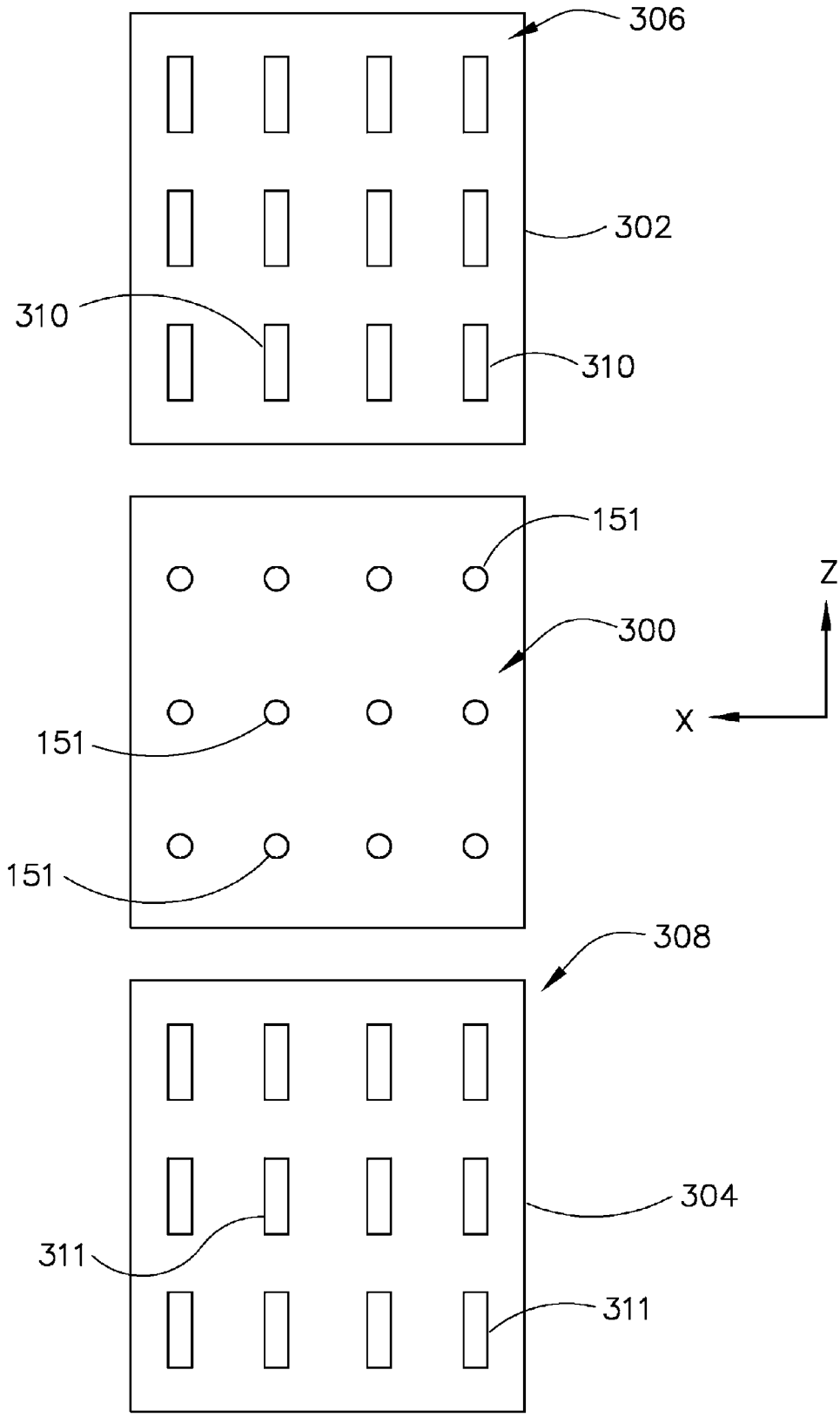
FIG. 8 illustrates a plan view of a plurality of focal spots in a modular device.

Referring now to FIG. 8, a plan view of a plurality 300 of focal spots 151 is illustrated. For illustration purposes, the plurality 300 of focal spots 151 is shown in conjunction with first and second sheets, or collimator plates 302, 304, that are each positioned to the side of focal spots 151. The 4×3 array of focal spots 151 illustrated corresponds, in this embodiment, to the 4×3 array of 12 target-electron source pairs illustrated in the module 100 in FIG. 3.

Each plate 302, 304 has a respective array 306, 308 of passageways, or apertures 310, 311 passing therethrough. The arrays 306, 308 of apertures 310, 311 are configured in a pattern that corresponds to the plurality 300 of focal spots 151 within each module 100. Consistent with the X-Y-Z coordinates illustrated in FIG. 7, apertures 310, 311 of plates 302, 304 are rectangular in shape, having an elongated side of each aperture 310, 311 along the Z-axis. Thus, apertures 310 are positioned in plate 302, and apertures 311 are positioned in plate 304. In the illustrated embodiments, the apertures 310, 311 in each plate 302, 304 are shown having approximately the same size, both between plates 302, 304, and from plate 302 to plate 304. However, embodiments of the invention described herein are not limited to apertures 310, 311 having the same sizes. Thus, apertures 310 in plate 302 may each have a size that is different from the apertures 311 in plate 304. Further, apertures 310 in plate 302 may vary in size in plate 302 and, likewise, apertures 311 in plate 304 may vary in size in plate 304.

Figure 9:
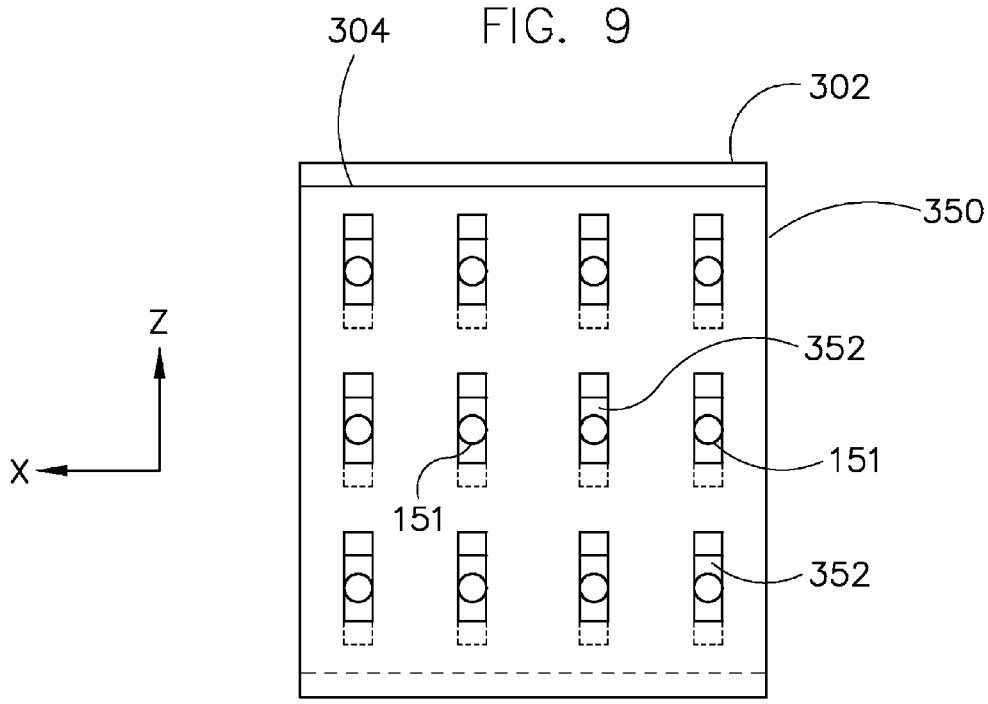
FIG. 9 illustrates a collimator according to an embodiment of the invention.
Figure 10:
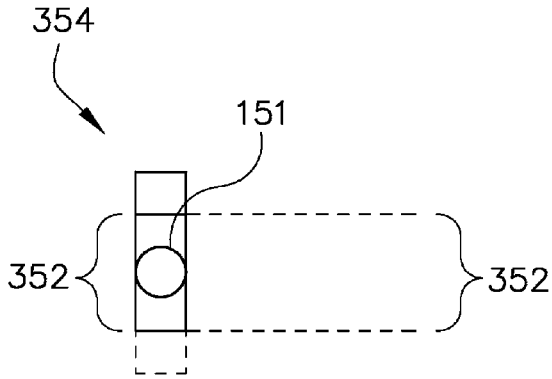
FIGS. 10 and 11 illustrate plan and side views of a composite opening of a collimator according to an embodiment of the invention.
Figure 11:
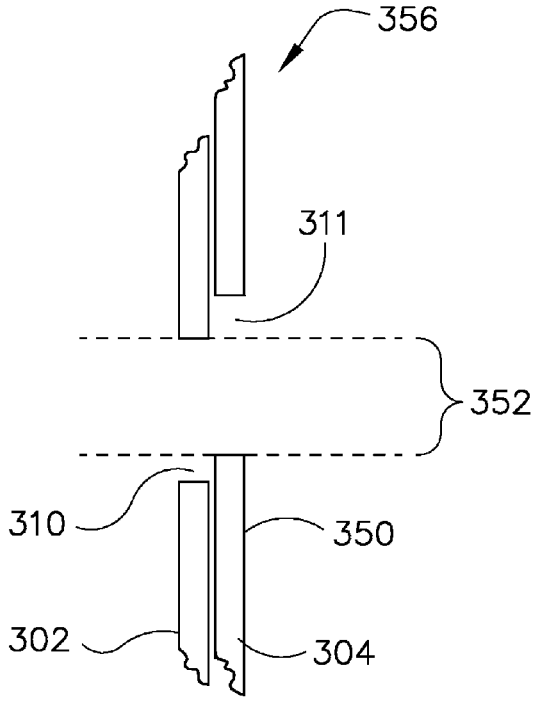

Referring now to FIG. 9, collimator 350 is formed by stacking the plates 302, 304 of FIG. 8 to form a plurality of composite openings 352 that correspond to the pattern of focal spots 151. As shown in FIGS. 10 and 11, a composite opening 352 in collimator 350 is illustrated, in both a plan view 354 (FIG. 10) and a side view 356 (FIG. 11), in relation to a focal spot 151. As illustrated, composite opening 352 is formed as a composite of the two openings—310 in plate 302, and 311 in plate 304. The two plates 302, 304 are offset from one another such that the composite opening 352 is smaller than each opening 310, 311 in the respective plates 302, 304.

Referring back to FIGS. 8 and 9, collimator 350 is thus formed by providing the two plates 302, 304 that each have respective openings 310, 311 therein. The two plates 302, 304 may be positioned offset from one another in the Z direction such that the plurality of composite openings 352 is formed, each of which corresponds to a respective focal spot 151. The collimator 350 may then be positioned with respect to the array of focal spots 151. In such fashion, both the composite opening 352 and the position of the collimator 350 may be precisely controlled to provide accurate and precise Z-collimation of each focal spot 151.

Figure 12:
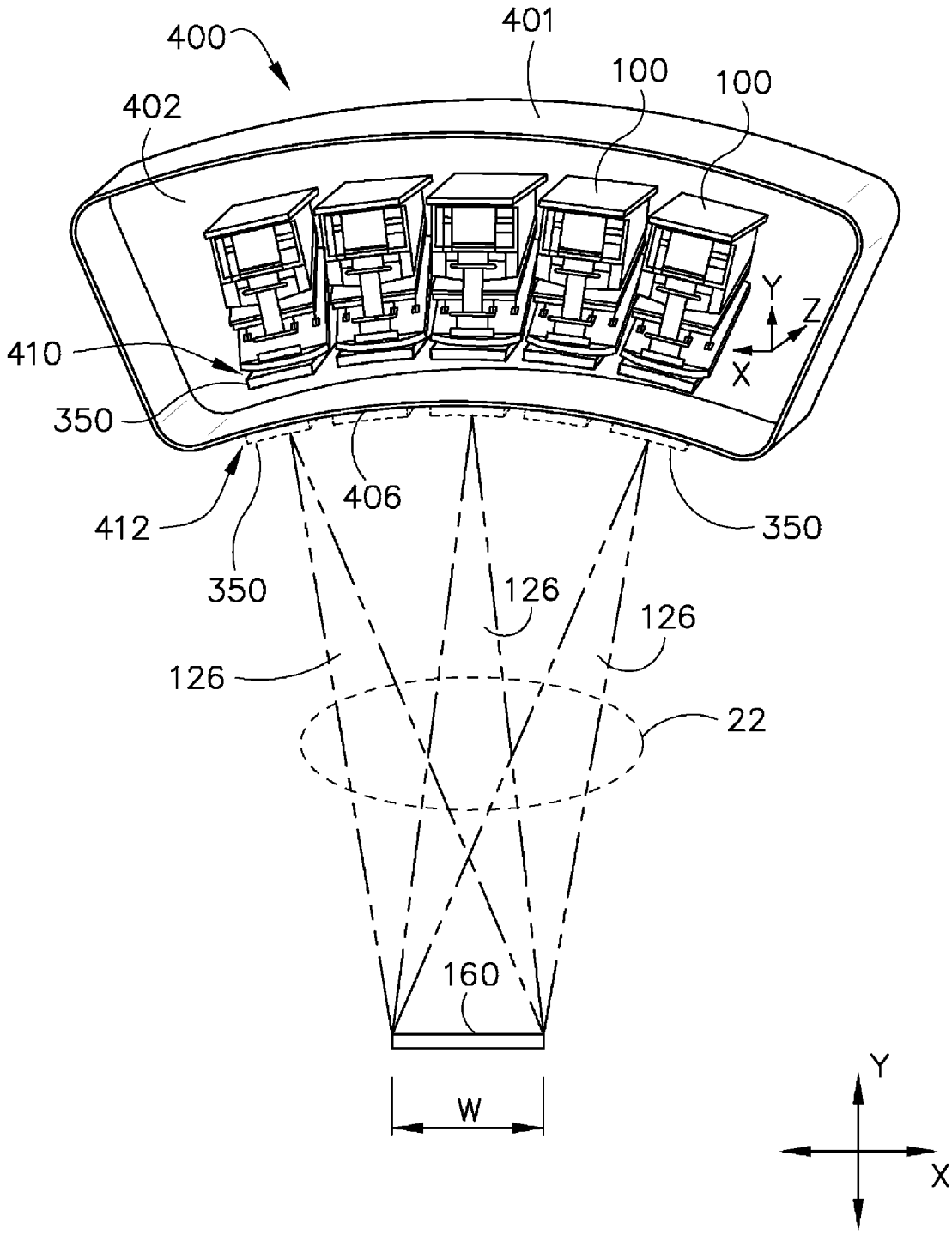
FIG. 12 illustrates a multi-spot source having collimators therein according to embodiments of the invention.

A collimator 350 may be fabricated having plates 302 and 304 in contact with one another. In embodiments where the plates 302, 304 are in contact, thus forming a single unit, the collimator 350 may be positioned on either a vacuum side or an air side of a multi-spot system. Referring now to FIG. 12, a multi-spot source 400 is illustrated having a collimator therein, according to embodiments of the invention. In the embodiments illustrated, a structure 401 encloses a vacuum region 402 and multi-spot modules 100 are positioned therein and are caused, as in the embodiments illustrated in FIG. 7, to emit x-rays toward detector 160. The structure 401 includes a wall 406 positioned generally between the modules 100 and the detector 160. Thus, in one embodiment, collimators 350 are positioned in a first location 410, within the vacuum region 402 and between the modules 100 and the wall 406 of structure 401. In another embodiment, collimators 350, shown in phantom at a second location 412, are positioned outside of the wall 406 of structure 401 and between the wall 406 and the detector 160 instead of in first location 410. In each embodiment the composite opening 352, as illustrated in FIGS. 10 and 11, is selected based on the distance from the respective focal spots 151. As such, referring back to FIG. 12, the composite opening 352 for a collimator 350 positioned at the first location 410 may be smaller than the composite opening 352 for a collimator 350 positioned at the second location 412.

Figure 13:
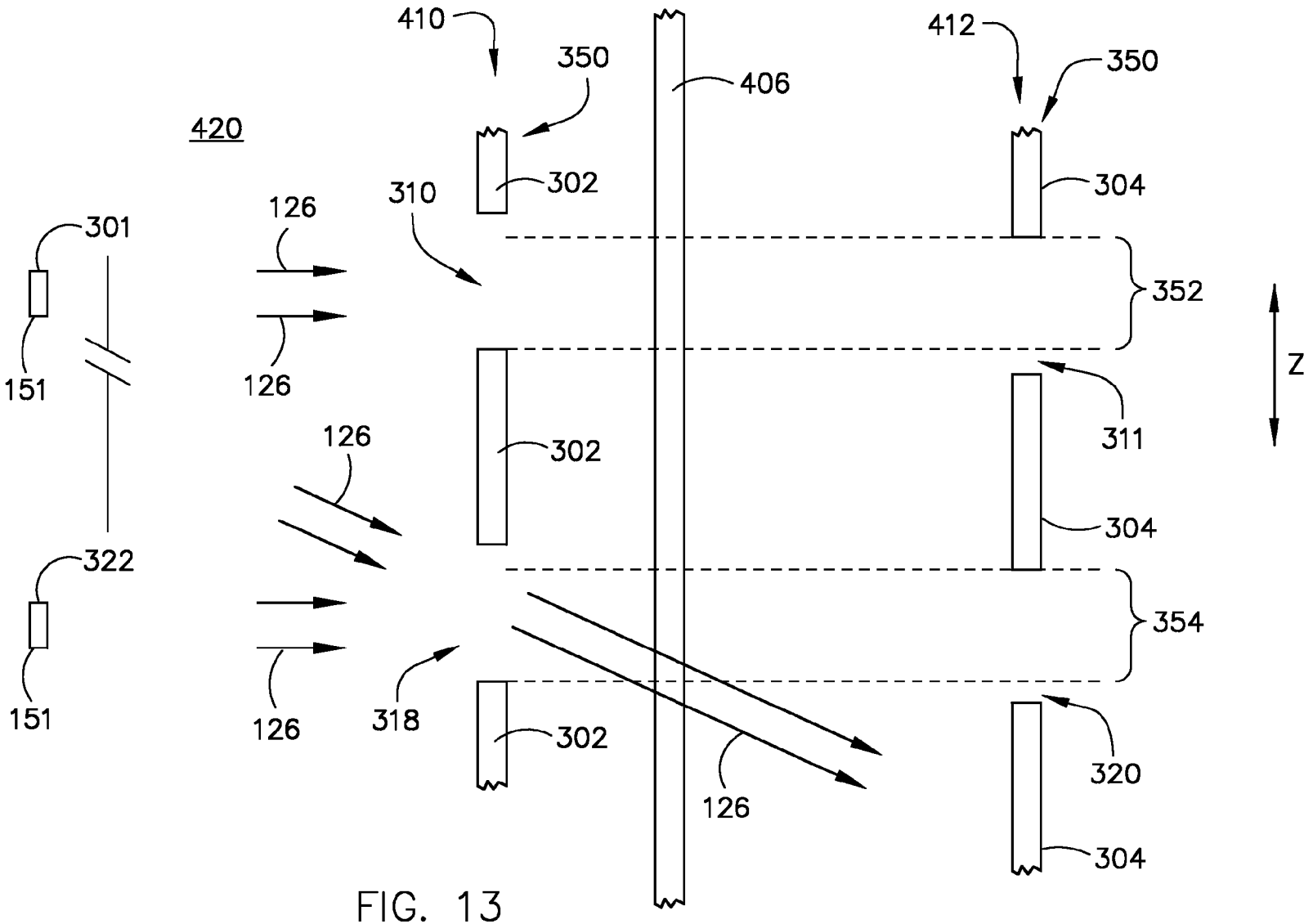
FIG. 13 illustrates a collimator according to an embodiment of the invention.

Additionally, although the plates 302, 304 are illustrated as being joined together in FIG. 11, embodiments of the invention described herein are not to be so limited. In another embodiment, plates 302 and 304 may be separated and positioned on either side of the wall 406 as illustrated in FIG. 13. In FIG. 13, collimator 350 is formed having a plate 302 with aperture 310 that may be positioned at the first location 410 within vacuum region 420 and within wall 406. Collimator 350 also includes plate 304 having aperture 311, and in this embodiment, plate 304 is placed outside wall 406 (on the air-side) at second location 412. Thus, in this embodiment, the plates 302, 304 are positioned and appropriately spaced apart such that a combined position of both plates 302, 304 have positioned therein respective apertures 310, 311, The plates 302, 304 are also positioned such that a composite opening 352 is formed with respect to focal spot 151 at position 301. Thus, x-rays 126 emitting from focal spot 151 at position 301 pass through composite opening 352 as they are directed toward a detector, such as detector 160 of FIG. 12.

However, first plate 302 includes a neighboring aperture 318, and second plate 304 likewise includes a neighboring aperture 320. The neighboring apertures 318, 320 are positioned to form another composite opening 354 that is positioned to allow passage of x-rays 126 that emit from another focal spot 151, labeled as position 322. However, in this embodiment, the plates are positioned such that, while x-rays 126 that emit from focal spot 151 at position 301 may pass through aperture 318 of the first plate 302, they are obstructed from passing all the way to detector 160 of FIG. 12, as those x-rays impinge the second plate 304.

Further, although the composite opening 352 of collimator 350 is illustrated with respect to the Z direction of the sources 200, 400 of FIGS. 7 and 12, one skilled in the art will recognize that the principles illustrated herein are equally applicable to collimation in the X-direction. Additionally, one skilled in the art will recognize that such principles could be applied to simultaneously control composite openings in both the X- and Z-direction within a single collimator that comprises two plates. Thus, oversize apertures may be positioned in each plate, as described above, but in both orientations X and Z, such that a single collimator may be precisely built and positioned according to the principles herein to provide collimation to both orientations, by appropriately positioning both plates with respect to each other in both orientations X and Z.

The collimators described herein need not be static, but may be designed in such a fashion that one or both plates of the collimator may be dynamically positionable. As such, one or both plates may be re-positioned during a scan, or between scans, depending on the application.

Figure 14:
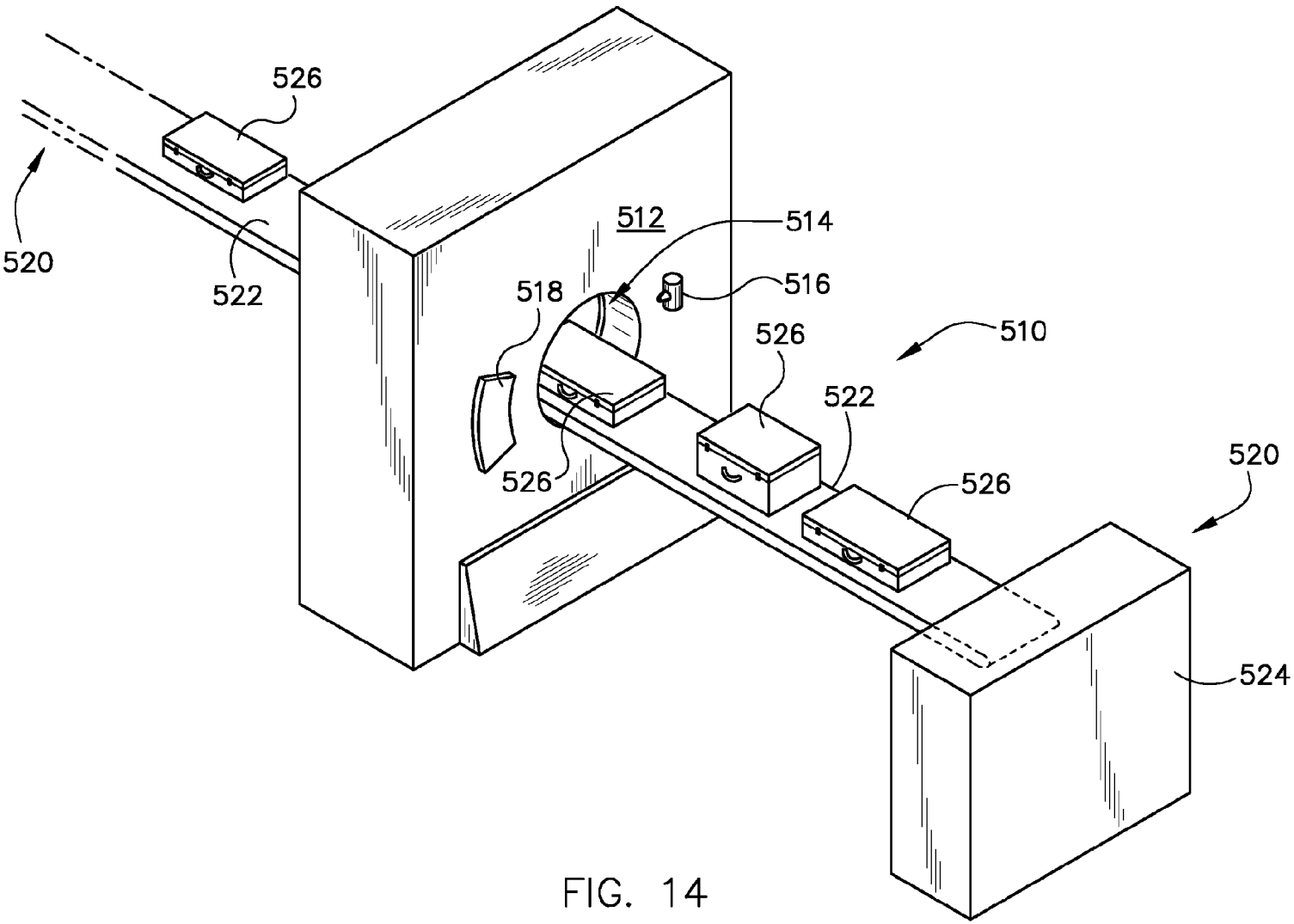
FIG. 14 illustrates a package/baggage inspection system according to an embodiment of the invention.

Referring now to FIG. 14, package/baggage inspection system 510 includes a rotatable gantry 512 having an opening 514 therein through which packages or pieces of baggage may pass. The rotatable gantry 512 houses an x-ray energy source 516 as well as a detector assembly 518 having scintillator arrays comprised of scintillator cells. A conveyor system 520 is also provided and includes a conveyor belt 522 supported by structure 524 to automatically and continuously pass packages or baggage pieces 526 through opening 514 to be scanned. Objects 526 are fed through opening 514 by conveyor belt 522, imaging data is then acquired, and the conveyor belt 522 removes the packages 526 from opening 514 in a controlled and continuous manner. As a result, postal inspectors, baggage handlers, and other security personnel may non-invasively inspect the contents of packages 526 for explosives, knives, guns, contraband, etc.

According to one embodiment of the invention a collimator includes a first plate having an aperture therein, the aperture configured to allow passage of a beam of x-rays from a source of a multi-spot source therethrough, and a second plate parallelly positioned with respect to the first plate and configured to receive and attenuate a first portion of the beam of x-rays passing through the aperture in the first plate, the second plate having an aperture therein configured to non-concentrically overlap the aperture in the first plate, to receive a second portion of the beam of x-rays passing through the aperture in the first plate, and to allow passage of the second portion of the beam of x-rays therethrough. A portion of the aperture in the first plate and a portion of the aperture in the second plate form a composite aperture parallel to the beam of x-rays, the composite aperture configured to allow passage of the second portion of the beam of x-rays through the first and second plates.

In accordance with another embodiment of the invention a method includes providing a multispot x-ray source having first and second focal spots that are in different positions from one another, providing a first collimator plate having a plurality of apertures therein, and providing a second collimator plate having a plurality of apertures therein, each aperture in the second collimator plate corresponding to a respective aperture in the first collimator plate to form a respective aperture pair. The method further includes positioning the first collimator plate substantially parallel to the second collimator plate and between the second collimator plate and the x-ray source, and offsetting an axial center of each aperture in each respective aperture pair from one another in a direction coplanar with the first collimator plate such that a composite opening is formed in each respective aperture pair between a portion of each aperture in each respective aperture pair.

Yet another embodiment of the invention includes an x-ray imaging system that includes a multispot x-ray source. The multispot source includes a first emitter positioned to emit a first x-ray beam toward an object, and a second emitter positioned to emit a second x-ray beam toward the object, the second emitter positioned in a different position from the position of the first emitter. The system also includes a collimator that includes a first x-ray-opaque sheet having a first aperture therein and positioned to receive x-rays from the first emitter, and a second x-ray-opaque sheet having a second aperture therein and positioned to receive x-rays that pass through the first x-ray-opaque sheet, wherein the second x-ray-opaque sheet is substantially parallel to the first metal sheet. The first aperture is parallelly offset from the second aperture such that the two apertures form a composite opening therethrough, the composite opening smaller than the first aperture, and the composite opening smaller than the second aperture.

The invention has been described in terms of the preferred embodiment, and it is recognized that equivalents, alternatives, and modifications, aside from those expressly stated, are possible and within the scope of the appending claims.

What is claimed is:

1. A collimator comprising:

a first plate having an aperture therein, the aperture configured to allow passage of a beam of x-rays through said aperture from a source of a multi-spot source therethrough and obstruct off-focal x-rays; and a second plate parallelly positioned offset with respect to the first plate and configured to receive the beam of x-rays passing through the aperture in the first plate, the second plate having an aperture therein configured to non-concentrically overlap the aperture in the first plate, and to allow passage of a second portion of the beam of x-rays from the aperture of the second plate therethrough and to obstruct off-focal x-rays;

wherein a portion of the aperture in the first plate and a portion of the aperture in the second plate are aligned to form a composite aperture passage smaller than a width of each said aperture, the composite aperture passage configured to allow passage of the beam of x-rays that are substantially parallel to the composite aperture passage to pass through each aperture of the first and second plates.

2. The collimator of claim 1 wherein the first plate has a neighboring aperture positioned in the first plate adjacent to the aperture, wherein the second plate is configured to attenuate x-rays that emit from the source through the neighboring aperture.

3. The collimator of claim 1 wherein the aperture in the first plate is one of an array of apertures formed through the first plate;

wherein the aperture in the second plate is one of an array of apertures formed through the second plate;

wherein each aperture in the first plate corresponds to a respective aperture in the second plate forming an array of respective aperture pairs; and wherein a portion of each respective aperture pair has a composite aperture configured to allow passage of a portion of x-rays therethrough that transmit through the aperture in the first plate of the respective aperture pair.

4. The collimator of claim 3 wherein each aperture in the array of apertures in first plate has approximately the same size and shape.

5. The collimator of claim 3 wherein each aperture in a respective aperture pair is approximately the same size and shape.

6. The collimator of claim 1 wherein one of the first and second plates comprise one of tungsten, lead, and molybdenum.

7. The collimator of claim 1 wherein a total thickness of the collimator is between approximately 2 mm and 4 mm.

8. The collimator of claim 1, wherein the plates are dynamically positionable.

9. The collimator of claim 1, wherein each composite aperture corresponds to a respective focal spot of the source.

10. A method comprising:

providing a multispot x-ray source having first and second focal spots that are in different positions from one another;

providing a first collimator plate having a plurality of apertures therein;

providing a second collimator plate having a plurality of apertures therein, each aperture in the second collimator plate corresponding to a respective aperture in the first collimator plate to form a respective aperture pair;

positioning the first collimator plate substantially parallel to the second collimator plate and between the second collimator plate and the x-ray source; and offsetting an axial center of each aperture in each respective aperture pair from one another in a direction coplanar with the first collimator plate such that a composite opening is formed in each respective aperture pair between a portion of each aperture in each respective aperture pair to form a collimator passage allowing only x-ray beams from the x-ray source that are substantially parallel to an axial center of the collimator passage to pass therethrough.

11. The method of claim 10 further comprising positioning the two plates such that the x-rays emitting from the first focal spot pass through one of the composite openings and such that x-rays emitting from the second focal spot fail to pass through the one of the composite openings.

12. The method of claim 10 further comprising positioning the first collimator plate on a vacuum-side of the x-ray source, and positioning the second collimator plate on an air-side of the x-ray source.

13. The method of claim 10 further comprising positioning the two plates such that x-rays emitting from the first focal spot pass through only one of the composite openings.

14. The method of claim 10 further comprising re-positioning at least one of the first and second collimator plates with respect to the multispot x-ray source during an imaging session.

15. The method of claim 14 wherein re-positioning further comprises re-positioning the at least one of the first and second collimator plates between scans of an imaging session.

16. An x-ray imaging system comprising:

a multispot x-ray source comprising:

a first emitter positioned to emit a first x-ray beam toward an object; and a second emitter positioned to emit a second x-ray beam toward the object, the second emitter positioned in a different position from the position of the first emitter; and a collimator comprising:

a first x-ray-opaque sheet having a first aperture therein and positioned to receive x-rays from the first emitter; and a second x-ray-opaque sheet having a second aperture therein and positioned to receive x-rays that pass through the first x-ray-opaque sheet, wherein the second x-ray-opaque sheet is substantially parallel to the first x-ray-opaque sheet;

wherein the first aperture is parallelly offset from the second aperture such that the two apertures form a composite opening therethrough with a corresponding collimator passage, the composite opening smaller than the first aperture, and the composite opening smaller than the second aperture, and wherein only the x-ray beam that is substantially parallel to the collimator passage reach the object.

17. The x-ray imaging system of claim 16 wherein the first aperture is one of an array of apertures in the first x-ray-opaque sheet, and wherein the second aperture is one of an array of apertures in the second x-ray-opaque sheet.

18. The x-ray imaging system of claim 16 further comprising a vacuum wall and wherein the first and second x-ray-opaque sheets are both positioned on one side of the vacuum wall.

19. The x-ray imaging system of claim 16 further comprising a vacuum wall and wherein the first x-ray-opaque sheet is positioned on one side of the vacuum wall, and wherein the second x-ray-opaque sheet is positioned on the other side of the vacuum wall.

20. The x-ray imaging system of claim 16 wherein the first and second x-ray-opaque sheet comprise one of tungsten, lead, and molybdenum.

21. The collimator of claim 16 wherein the first and second x-ray-opaque sheets are individually positionable with respect to the x-ray source.

22. The collimator of claim 21 wherein the first and second x-ray-opaque sheets are individually positionable during an imaging session.

* * * * *